US006199579B1

(12) United States Patent
Taylor et al.

(10) Patent No.: US 6,199,579 B1
(45) Date of Patent: Mar. 13, 2001

(54) HOSE HANDLING SYSTEM AND METHOD

(75) Inventors: Ken W. Taylor, Oak Ridge, NC (US); Orville N. Fleming, Jr., Greenbackville, VA (US)

(73) Assignee: Dresser Equipment Group, Inc., Carrollton, TX (US)

( * ) Notice: Subject to any disclaimer, the term of this patent is extended or adjusted under 35 U.S.C. 154(b) by 0 days.

(21) Appl. No.: 09/546,751

(22) Filed: Apr. 11, 2000

Related U.S. Application Data

(60) Provisional application No. 60/129,148, filed on Apr. 14, 1999.

(51) Int. Cl.[7] ..... B65H 75/34

(52) U.S. Cl. ..... 137/355.22; 137/355.23; 137/355.24; 137/355.25; 212/47.5

(58) Field of Search ..... 137/355.23, 355.24, 137/355.25, 355.22; 242/47.5

(56) References Cited

U.S. PATENT DOCUMENTS

| | | | | |
|---|---|---|---|---|
| 955,342 | | 4/1910 | Maxwell . | |
| 2,117,928 | | 5/1938 | Wardell | 267/73 |
| 4,131,218 | * | 12/1978 | Tatsuno | 222/527 |
| 4,380,244 | | 4/1983 | Caudill et al. | 137/355 |
| 5,018,549 | * | 5/1991 | Lucas | 137/355.23 |
| 5,450,874 | | 9/1995 | Hamula | 137/355.25 |
| 5,727,765 | * | 3/1998 | Alvern | 248/329 |
| 5,775,354 | * | 7/1998 | Upton | 137/1 |

* cited by examiner

*Primary Examiner*—A. Michael Chambers
*Assistant Examiner*—Thomas L. McShane
(74) *Attorney, Agent, or Firm*—Haynes and Boone, LLP

(57) ABSTRACT

A system and method for handling a hose, according to which the hose is clamped to a clamp and the clamp is moved between a first position in which the hose is retracted and a second position in which the hose is extended. Manual movement of the hose from its retracted position is sensed and the clamp is driven to its second position, and manual movement of the hose from its extended position is sensed and the clamp is driven to its first position.

20 Claims, 2 Drawing Sheets

HOSE HANDLING SYSTEM AND METHOD

CROSS-REFERENCE TO RELATED APPLICATION

This application claims priority of provisional application Ser. No. 60/129,148 filed Apr. 14, 1999.

BACKGROUND

This disclosure relates to a hose handling system and method and, more particularly, to such a system and method utilizing power assistance to aid in handling a hose.

There are several applications in which relatively heavy hoses must be moved. For example, in self service gasoline service stations employing a number of gasoline pumps, or dispensing units, hoses are provided that connect the dispensing unit to a dispensing nozzle. Many of these installations utilize a simple "high hose" connection in which one end of the dispensing hose is mounted to the housing of the dispenser unit at a relative high elevation that exceeds the length of the hose. As a result, this type of connection eliminates hose drag, takes a good part of the weight of the hose, and allows customers good reach.

However, in these types of systems the hanging exposed hoses are somewhat unsightly and can obscure displays and pump controls. Also, they require a safety breakaway to prevent a fuel shower if the hose breaks away at the top. Further, in installations that require refueling on the far side of a vehicle, the length of the hose has to exceed the height at which it is mounted to the dispenser unit housing. Thus, the hose either drags on the ground, or some type of retractor system has to be used to keep the excess hose off the ground.

Other gasoline dispensing installations use a low hose connection in which one end of the dispensing hoses is mounted to the housing of the dispenser unit at a relative low elevation that is less that the length of the hose. Therefore these installations incorporate devices, such as retracts, spring arms, pulleys, weights, or the like, in the housing of the dispenser unit to enable a portion of the hose to be retracted into the housing during non-use.

However, in these low hose connections the customer usually has to provide the power to extend the hose during use. Since the hoses are relatively heavy, it is often difficult for a customer to extend, handle and retract the hose during the gasoline dispensing operation.

Therefore, what is needed is a hose handling and guide system according to which the hose can easily be extended, handled, guided, and retracted back into the dispenser unit.

SUMMARY

Accordingly, an embodiment of the present invention is directed to a hose handling system and method according to which the hose is clamped to a clamp and the clamp is moved between a first position in which the hose is retracted and a second position in which the hose is extended. Manual movement of the hose from its retracted position is sensed and the clamp is driven to its second position, and manual movement of the hose from its extended position is sensed and the clamp is driven to its first position.

Several advantages result from the above. For example, the hose can be easily extended from the dispensing unit, handled, guided, and retracted back into the dispenser unit.

DETAILED DESCRIPTION

Figure 2:
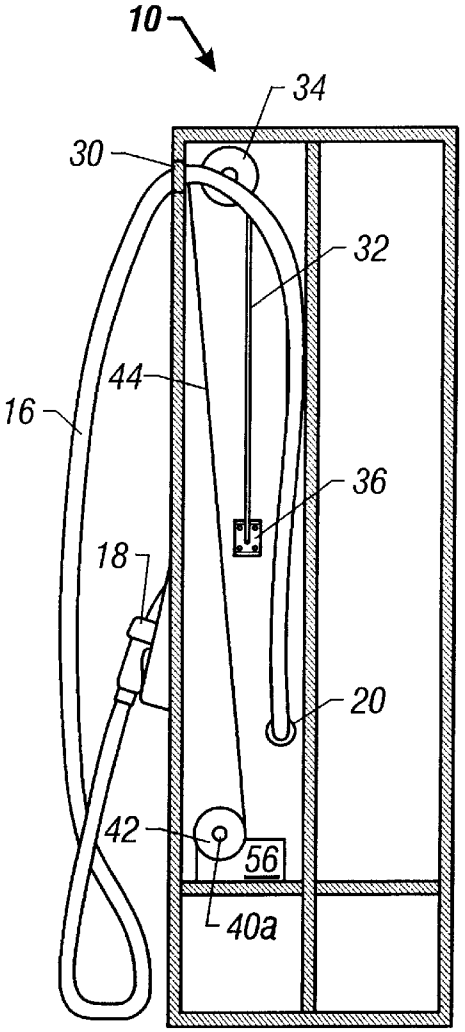
FIG. 2 is cross-sectional view taken along the line 2—2 of FIG. 1.
Figure 1:
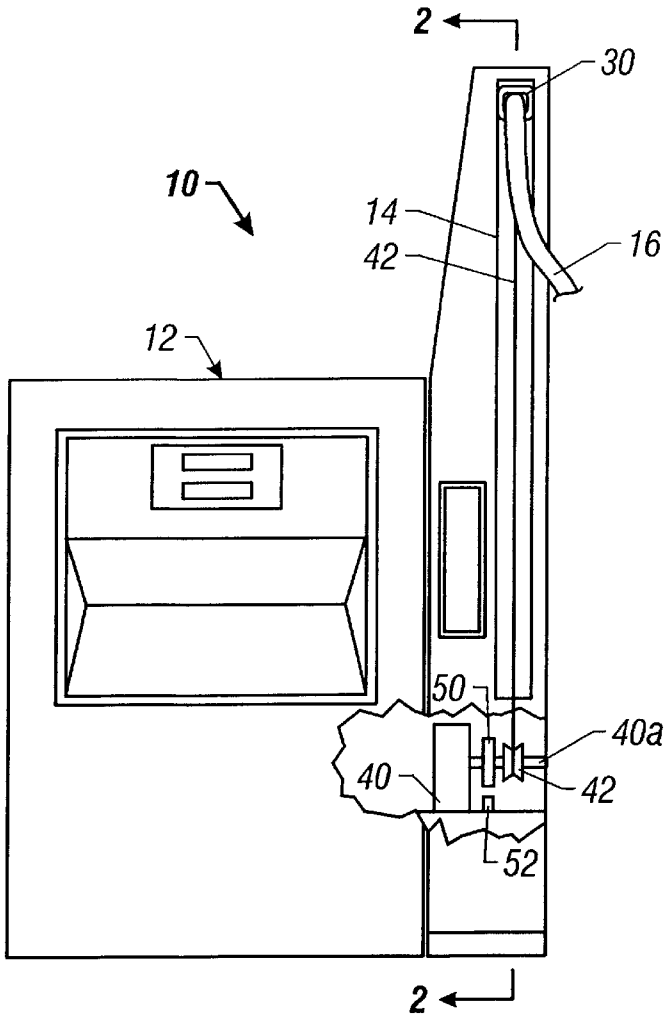
FIG. 1 is a front elevational view of the hose handling system according to an embodiment of the present invention.

Referring to FIGS. 1 and 2 of the drawings, a gasoline dispenser unit is referred to, in general, by the reference numeral 10 and includes a two-tiered housing 12 having a slide guideway 14 formed in a front panel thereof. A dispensing hose 16 extends through the guideway 14 with one end of the hose being connected to a dispensing nozzle 18 and the other end of the hose connected to a fixture 20 in the housing. It is understood that the fixture 20 is also connected to a conduit (not shown) extending from an underground storage tank for supplying fuel to the hose 16 for dispensing through the nozzle 18, in a conventional manner.

Figure 3:
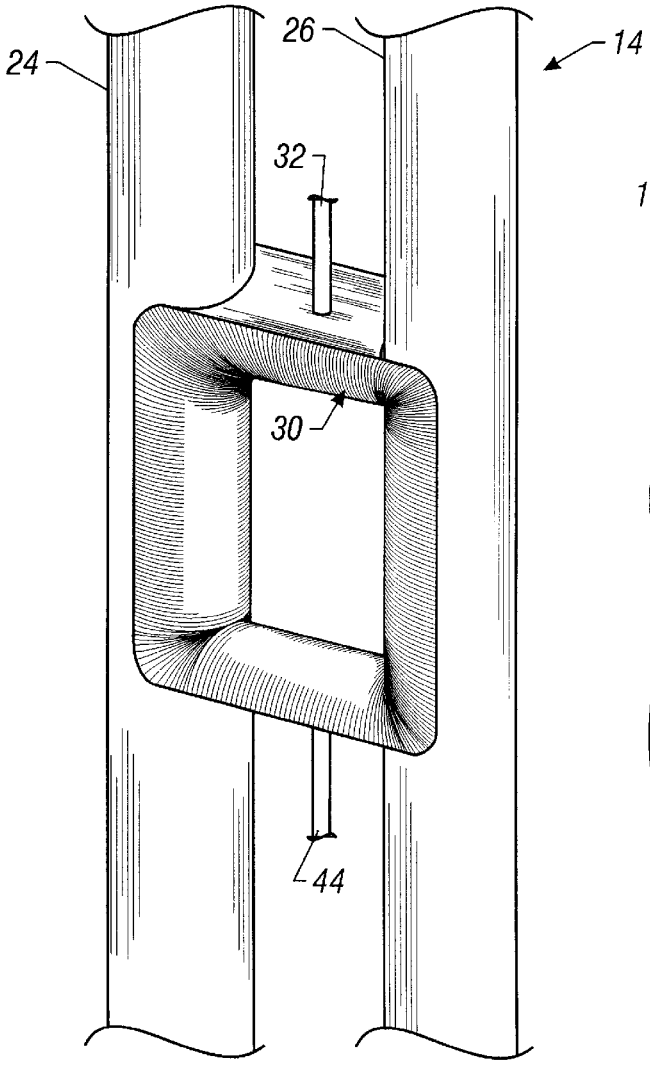
FIG. 3 is an enlarged isometric view of a portion of the hose handling system of FIGS. 1 and 2.
Figure 4:
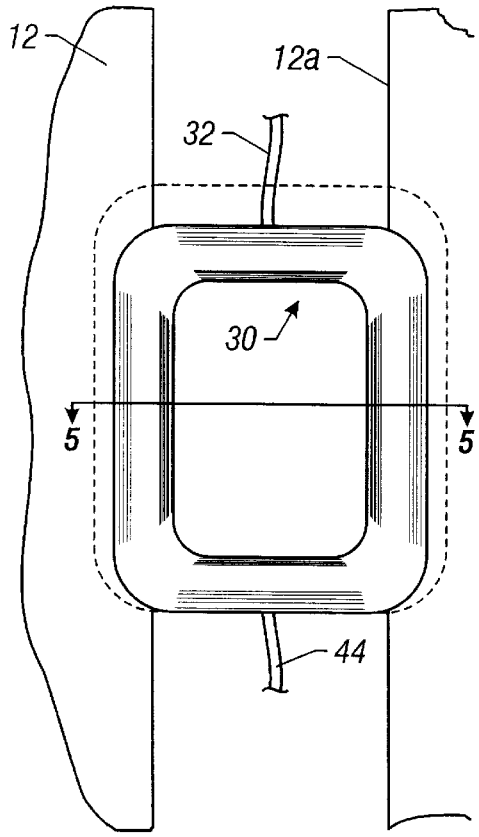
FIG. 4 is a partial, front elevational view of a portion of the hose handling system shown in FIG. 3.
Figure 2:
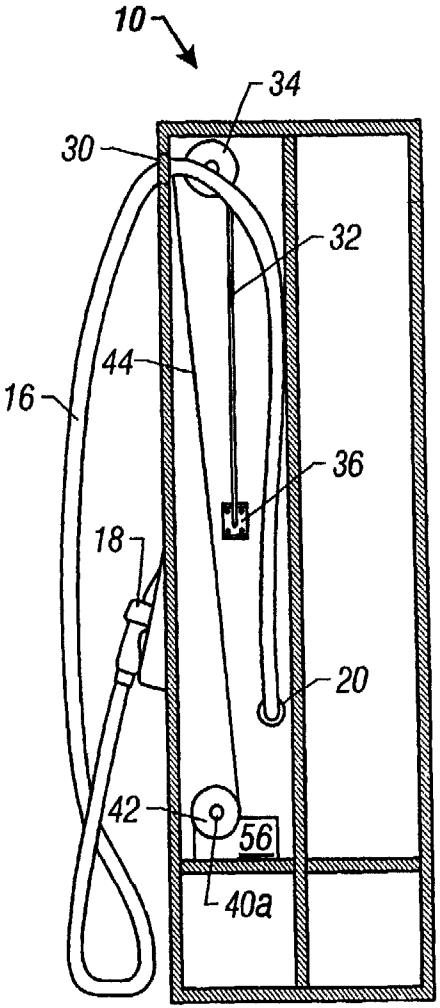
Figure 1:
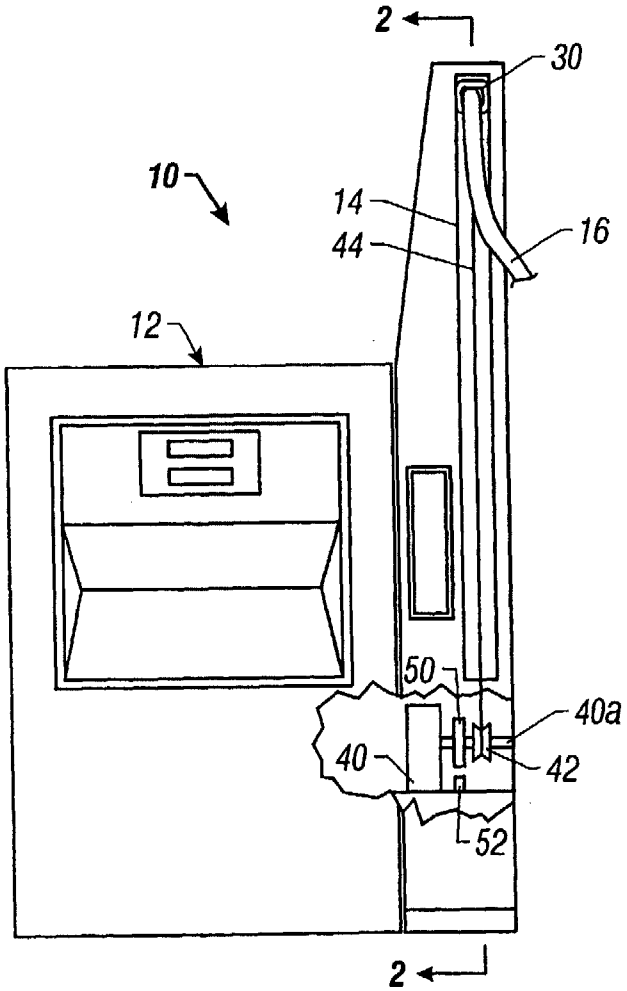

As shown in FIGS. 3 and 4, the guideway 14 consists of two spaced, parallel, upright members 24 and 26 mounted in the housing 12 in any conventional manner. A rectangularly-shaped hose clamp 30 is mounted for slidable movement in the guideway 14. To this end, the members 24 and 26 are provided with a convex curve in a horizontal plane, and the corresponding outer surfaces of the clamp 30 are provided with a complementary concave curve. Thus, the corresponding surfaces of the clamp 30 mate with those of the members 24 and 26 in a manner to retain the clamp in the guideway 14 while permitting the slidable movement. The clamp 30 defines a rectangular opening which is sized so that it receives the hose in a clamping engagement. The hose 16 is not shown in FIGS. 3 and 4 for the convenience of presentation.

A rubber tension cord 32 is connected at one end to the upper portion of the clamp 30 and, as shown in FIG. 2, extends around a pulley 34 rotatably mounted in the upper portion of the housing 12, and is connected at its other end to a fixture 36 in the interior of the housing 12. The design is such that the cord 32 is placed in tension when installed in the above manner and thus applies an upwardly directed force to the clamp 30, as viewed in FIG. 2.

A power source, such as a hydraulic or electric motor 40, is mounted in the lower portion of the housing 12, and a pulley 42 is connected to the output shaft 40*a* of the motor for rotation with the shaft. A rope 44, preferably fabricated from wire, or the like, is connected at its ends to the pulley 42 and the lower portion of the clamp 30, respectively. Rotation of the pulley 42 by the motor 40 in one direction places tension on the rope and thus applies a downwardly-directed force on the clamp 30 to pull it downwardly in the guideway 14, as viewed in FIGS. 1 and 2.

A magnetic wheel 50 mounted on the output shaft 40*a* of the motor 40 for rotation with the shaft, and at least one hall effect sensor 52 is mounted adjacent the wheel 50. The sensor 52 is conventional and, as such, senses the direction and amount of any rotation of the wheel 50, and therefore the output shaft 40*a* of the motor 40, and generates a corresponding output signal.

A motor control mechanism 56 is mounted in the housing 12 and is electrically connected to the motor 40 and the sensor 52. The control mechanism 56 receives the output signals from the sensor 52 corresponding to the amount and direction of rotation of the output shaft 40*a*, and controls the motor 40 accordingly. To this end, it is understood that the control mechanism 56 includes a forward/reverse valve or switch and a speed control (not shown), as well as a microprocessor running a software program to interpret the signals from the sensor 52 and generate corresponding output signals. Thus, the magnetic wheel 50 and the sensor 52 respond to the handling of the hose by the customer in a manner to be described and determine whether or not the hose 16 should be extended or retracted by corresponding movement of the clamp 30, and the control mechanism 56 functions to control the motor 40 accordingly.

When the clamp 30, and therefore the corresponding portion of the hose 16, are in the uppermost position in the guideway 14 as shown in FIGS. 2 and 3, the effective horizontal length of the portion of the hose that extends from the housing 12 is at a minimum, which hereinafter will be referred to as the "retracted" position of the hose. Conversely, when the clamp 30 is in its lowermost position in the guideway 14 the effective horizontal length of the portion of the hose 16 that extends from the housing 12 is at a maximum, which hereinafter will be referred to as the "extended" position of the hose.

When the system is inactive, the motor 40 is shut off and the tension cord 32 urges the clamp 30 to a rest position in the upper portion of the guideway 14 as shown in FIG. 1 so that the hose 16 is in its retracted position. When a customer initially pulls on the hose 16 to initiate a dispensing operation, this causes a slight rotation of the pulley 40 and the wheel 50 in the corresponding direction, which rotation is sensed by the sensor 52. A corresponding signal is sent to the control mechanism 56 which activates the motor 40 accordingly to rotate the pulley 42 in the latter direction which places a tension on the rope 44 and a force on the clamp 30 that is opposite, and slightly greater than, the force applied as a result of the tension on the cord 32. Thus, the rope 44 winds on the pulley and pulls, or drives, the clamp 30, and therefore the hose 16, downwardly in the guideway 14 thus permitting the customer to pull the hose 16 to its extended position. During this movement additional tension is placed on the cord 32.

This movement continues in small increments until no pull is felt on the hose 16 which occurs when the customer has placed the hose in the desired dispensing position. Thus, the sensor 52 does not sense any rotation of the wheel 50, and a corresponding signal is sent to the control mechanism 56 which sends a signal to the motor 40 that locks the motor, and therefore the clamp 30, in the dispensing position.

When the customer has finished fueling and moves to replace the nozzle 16 thus relaxing the hose 14, this is sensed by the sensor 52 which releases the motor from its locked position. In this situation the force applied to the clamp 30 by the tensioned cord 32 slightly exceeds the force maintained on the clamp by the motor, via the rope 44. This, in turn, causes a slight torque to be applied to the shaft 40*a* of the motor 40 to tend to rotate the shaft in a direction opposite the direction discussed above. This torque is detected by the sensor 52, and the motor 40 is controlled accordingly to place a controlled amount of counter-force on the clamp 30 during this movement which continues to be less than the force resulting from the tension applied by the cord 32. Thus, the hose 16 is driven relatively slowly from its extended position to its retracted position. When the clamp 30 reaches its uppermost position shown in FIGS. 1 and 2, the rotation of the wheel 50 terminates and a signal is sent to the motor 40 in the above matter to shut it off and the tension in the cord 32 maintains the clamp 30 in the uppermost position.

Thus, the hose 16 can be easily extended from the housing 12, handled, guided, and retracted back into the unit with the power assist from the motor 40 and the cord 32 described above.

It is understood that variations may be made in the foregoing without departing from the scope of the invention. For example the power source can be a hydraulic motor, a pneumatic motor or cylinder, a vacuum motor or actuator, a linear electric actuator, or a series of pulleys and weights. In this context, self-contained gasoline dispensing units usually include electric and hydraulic motors for use in the gasoline dispensing operation. Thus, these units could be used in the present system since they would always be available both before and after the fuel is being dispensed, which is when the system of the above embodiment operates.

Also, the sensing apparatus can be in the form of a pressure transducer, an attitude device, a strain gauge, a potentiometer; or a series of switches. It is understood that the spatial references referred to above, such as "upper", "lower", "downward", "vertical", "horizontal" etc. are made for the purposes of example only and are not intended to limit the specific orientation of the particular structure involved.

Since other modifications, changes, and substitutions are intended in the foregoing disclosure, it is appropriate that the appended claims be construed broadly and in a manner consistent with the scope of the invention.

What is claimed is:

1. A hose handling and guide system comprising a housing defining a guideway, a clamp clamped to the hose and mounted for slidable movement in the guideway between a first position in which the hose is retracted and a second position in which the hose is extended, means responsive to manual movement of the hose from its retracted position for driving the clamp to its second position, the driving means being responsive to manual movement of the hose from its extended position for driving the clamp to its first position.

2. The system of claim 1 wherein the driving means comprises a tension cord connected to the clamp for applying a force to the clamp to move it towards its first position.

3. The system of claim 2 wherein the driving means further comprises a power source, and a rope connecting the power source to the clamp for applying a force to the clamp to move it towards its second position.

4. The system of claim 3 wherein the movement of the clamp to its second position increases the tension on the tension cord.

5. The system of claim 3 wherein the power source locks the clamp in its second position.

6. The system of claim 5 wherein, upon unlocking of the power source the tension on the tension cord applies a force to the clamp to move it to its first position, and wherein, during the latter movement, the power source applies a counter force to the clamp that is less than the force applied by the tension cord.

7. The system of claim 1 further comprising a sensor associated with the power source for sensing the manual movement and controlling the power source accordingly.

8. The system of claim 7 wherein the sensor senses the manual movement of the clamp from its first position and activates the power source to drive the clamp to its second position.

9. The system of claim 8 wherein the power source locks the clamp in its second position.

10. The system of claim 8 wherein the sensor senses the manual movement of the clamp from its second position and activates the power source to apply a counter force to the clamp that is less than the force applied by the tension cord.

11. A method of handling an guiding a hose comprising the steps of clamping the hose to a clamp, moving the clamp between a first position in which the hose is retracted and a second position in which the hose is extended, responding to manual movement of the hose from its retracted position for driving the clamp to its second position, and responding to manual movement of the hose from its extended position for driving the clamp to its first position.

12. The method of claim 11 further comprising the step of attaching a tension cord to the claim, wherein the movement of the clamp to its second position applies a tension to the cord, and wherein the tension cord drives the clamp to its first position.

13. The method of claim 12 further comprising the steps of attaching a rope to the clamp and the power source, and activating the power source to drive the clamp to its second position.

14. The method of claim 13 wherein the movement of the clamp to its second position increases the tension on the tension cord.

15. The method of claim 13 further comprising the step of locking the clamp in its second position.

16. The method of claim 15 wherein, upon unlocking of the power source the tension on the tension cord applies a force to the clamp to move it to its first position, and wherein, during the latter movement, the power source applies a counter force to the clamp that is less than the force applied by the tension cord.

17. The method of claim 11 further comprising the steps of sensing the manual movement and controlling the power source accordingly.

18. The method of claim 11 further comprising the steps of sensing the manual movement of the clamp from its first position and activating the power source to drive the clamp to its second position.

19. The method of claim 18 further comprising the step of locking the clamp in its second position.

20. The method of claim 18 further comprising the steps of sensing the manual movement of the clamp from its second position and activating the power source to apply a counter force to the clamp that is less than the force applied by the tension cord.

* * * * *

UNITED STATES PATENT AND TRADEMARK OFFICE

CERTIFICATE OF CORRECTION

PATENT NO. : 6,199,579 B1
DATED : March 13, 2001
INVENTOR(S) : Ken W. Taylor, Orville N. Fleming Jr.

It is certified that error appears in the above-identified patent and that said Letters Patent is hereby corrected as shown below:

The title page should be deleted and substitute therefore the attached title page.

(12) United States Patent
Taylor et al.

(10) Patent No.: US 6,199,579 B1
(45) Date of Patent: Mar. 13, 2001

(54) HOSE HANDLING SYSTEM AND METHOD

(75) Inventors: Ken W. Taylor, Oak Ridge, NC (US); Orville N. Fleming, Jr., Greenbackville, VA (US)

(73) Assignee: Dresser Equipment Group, Inc., Carrollton, TX (US)

( * ) Notice: Subject to any disclaimer, the term of this patent is extended or adjusted under 35 U.S.C. 154(b) by 0 days.

(21) Appl. No.: 09/546,751

(22) Filed: Apr. 11, 2000

Related U.S. Application Data

(60) Provisional application No. 60/129,148, filed on Apr. 14, 1999.

(51) Int. Cl.[7] ..... B65H 75/34

(52) U.S. Cl. ..... 137/355.22; 137/355.23; 137/355.24; 137/355.25; 212/47.5

(58) Field of Search ..... 137/355.23, 355.24, 137/355.25, 355.22; 242/47.5

(56) References Cited

U.S. PATENT DOCUMENTS

| | | | | |
|---|---|---|---|---|
| 955,342 | | 4/1910 | Maxwell . | |
| 2,117,928 | | 5/1938 | Wardell | 267/73 |
| 4,131,218 | * | 12/1978 | Tatsuno | 222/527 |
| 4,380,244 | | 4/1983 | Caudill et al. | 137/355 |
| 5,018,549 | * | 5/1991 | Lucas | 137/355.23 |
| 5,450,874 | | 9/1995 | Hamula | 137/355.25 |
| 5,727,765 | * | 3/1998 | Alvern | 248/329 |
| 5,775,354 | * | 7/1998 | Upton | 137/1 |

* cited by examiner

*Primary Examiner*—A. Michael Chambers
*Assistant Examiner*—Thomas L. McShane
(74) *Attorney, Agent, or Firm*—Haynes and Boone, LLP

(57) ABSTRACT

A system and method for handling a hose, according to which the hose is clamped to a clamp and the clamp is moved between a first position in which the hose is retracted and a second position in which the hose is extended. Manual movement of the hose from its retracted position is sensed and the clamp is driven to its second position, and manual movement of the hose from its extended position is sensed and the clamp is driven to its first position.

20 Claims, 2 Drawing Sheets

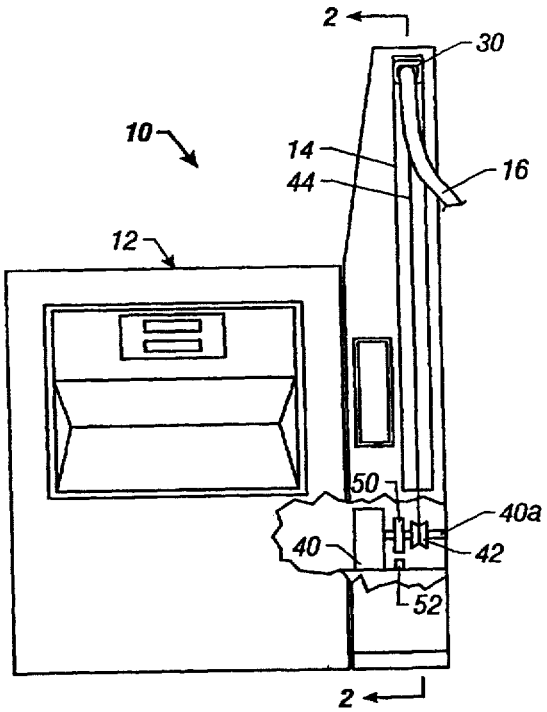

UNITED STATES PATENT AND TRADEMARK OFFICE

CERTIFICATE OF CORRECTION

PATENT NO. : 6,199,579 B1
DATED : March 13, 2001
INVENTOR(S) : Ken W. Taylor, Orville N. Fleming Jr.

It is certified that error appears in the above-identified patent and that said Letters Patent is hereby corrected as shown below:

Drawings,
Sheet 1 of 2, Figure 1, change the numeral "42" pointing to the rope to -- 44 -- as shown on attached page.

Column 3,
Line 30, change "40" to -- 42 --.

Column 4, claim 11,
Line 65, change "an" to -- and --.

Column 5, claim 12,
Line 7, change "claim" to -- clamp --.

Signed and Sealed this

Fourth Day of December, 2001

*Attest:*

Nicholas P. Godici

*Attesting Officer*

NICHOLAS P. GODICI
*Acting Director of the United States Patent and Trademark Office*